US010930223B2

(12) United States Patent
Pytlarz et al.

(10) Patent No.: US 10,930,223 B2
(45) Date of Patent: Feb. 23, 2021

(54) AMBIENT LIGHT-ADAPTIVE DISPLAY MANAGEMENT

(71) Applicant: Dolby Laboratories Licensing Corporation, San Francisco, CA (US)

(72) Inventors: Jaclyn Anne Pytlarz, Sunnyvale, CA (US); Robin Atkins, San Jose, CA (US); Gopi Lakshminarayanan, Fremont, CA (US); Hariharan Ganapathy Kathirvelu, Santa Clara, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/345,192

(22) PCT Filed: Dec. 20, 2017

(86) PCT No.: PCT/US2017/067754
§ 371 (c)(1),
(2) Date: Apr. 25, 2019

(87) PCT Pub. No.: WO2018/119161
PCT Pub. Date: Jun. 28, 2018

(65) Prior Publication Data

US 2019/0304379 A1 Oct. 3, 2019

Related U.S. Application Data

(60) Provisional application No. 62/437,960, filed on Dec. 22, 2016, provisional application No. 62/531,232, (Continued)

(30) Foreign Application Priority Data

Feb. 1, 2017 (EP) ..... 17154164

(51) Int. Cl.
*G09G 3/34* (2006.01)

(52) U.S. Cl.
CPC ... *G09G 3/3406* (2013.01); *G09G 2320/0238* (2013.01); *G09G 2320/0271* (2013.01); (Continued)

(58) Field of Classification Search
CPC ... G09G 2320/0238; G09G 2320/0271; G09G 2320/0276; G09G 2320/0606; (Continued)

(56) References Cited

U.S. PATENT DOCUMENTS 7,894,000 B2 2/2011 Gutta
8,096,695 B2 1/2012 Ong
(Continued)

FOREIGN PATENT DOCUMENTS

EP 2224696 9/2010

OTHER PUBLICATIONS

Zhang,Dan., "Appearance-based image splitting for HDR display systems", PUB: Apr. 1, 2011, Rochester Institute of Technology, Scholar Works, Thesis/Dissertation Collections.
(Continued)

*Primary Examiner* — Ram A Mistry

(57) ABSTRACT

Methods are disclosed for ambient light-adaptive display management. Given an input image, image metadata, an ambient-light signal, and parameters characterizing a target display, a processor generates an ambient-light adjustment function which maps input luminance values in a reference viewing environment to output luminance values in a target viewing environment, wherein the target viewing environment is determined based on the ambient-light signal. The ambient-light adjustment function is applied to the input image and the input metadata to generate a virtual image and new metadata. A tone-mapping function based on the new
(Continued)

metadata and target display parameters is applied to the virtual image to generate an output image. The parameters for the target display are computed based on the ambient-light signal, global dimming metadata, and the luminance characteristics of the target display.

18 Claims, 6 Drawing Sheets

Related U.S. Application Data filed on Jul. 11, 2017, provisional application No. 62/563,247, filed on Sep. 26, 2017.

(52) U.S. Cl.
CPC ..... *G09G 2320/0276* (2013.01); *G09G 2320/0606* (2013.01); *G09G 2320/066* (2013.01); *G09G 2320/0646* (2013.01); *G09G 2320/0666* (2013.01); *G09G 2340/06* (2013.01); *G09G 2360/144* (2013.01); *G09G 2360/16* (2013.01)

(58) Field of Classification Search
CPC ..... G09G 2320/0646; G09G 2320/066; G09G 2320/0666; G09G 2340/06; G09G 2360/144; G09G 2360/16; G09G 3/3406
See application file for complete search history.

(56) References Cited

U.S. PATENT DOCUMENTS

| | | | | |
|---|---|---|---|---|
| 8,531,379 | B2 | 9/2013 | Kerofsky | |
| 8,576,340 | B1 | 11/2013 | Li | |
| 8,593,480 | B1 * | 11/2013 | Ballestad ..... | H04N 1/6027 345/590 |
| 9,113,511 | B2 | 8/2015 | Lum | |
| 9,961,237 | B2 | 5/2018 | Atkins | |
| 10,140,953 | B2 | 11/2018 | Wanat | |
| 2005/0057484 | A1 | 3/2005 | Diefenbaugh | |
| 2006/0274026 | A1 | 12/2006 | Kerofsky | |
| 2010/0163717 | A1 | 7/2010 | Chang | |
| 2010/0201275 | A1 | 8/2010 | Cok | |
| 2011/0227966 | A1 | 9/2011 | Mori | |
| 2014/0016880 | A1 | 1/2014 | Kerofsky | |
| 2015/0248872 | A1 | 9/2015 | Fleureau | |
| 2015/0305117 | A1 | 10/2015 | Van Herpen | |
| 2016/0005349 | A1 * | 1/2016 | Atkins ..... | H04N 9/68 345/591 |
| 2016/0071484 | A1 | 3/2016 | Ballestad | |

OTHER PUBLICATIONS

ITU-R BT. 2100 "Image Parameter Values for High Dynamic Range Television for Use in Production and International Programme Exchange" ITU, Jul. 2016.

* cited by examiner

AMBIENT LIGHT-ADAPTIVE DISPLAY MANAGEMENT

CROSS-REFERENCE TO RELATED APPLICATIONS

This application claims the benefit of U.S. Provisional Patent Application Nos. 62/437,960, filed on Dec. 22, 2016; 62/531,232, filed on Jul. 11, 2017; 62/563,247, filed on Sep. 26, 2017; and European Patent Application No. 17154164.2 filed on Feb. 1, 2017, each of which is incorporated herein by reference.

TECHNOLOGY

The present invention relates generally to images. More particularly, an embodiment of the present invention relates to adaptive display management for displaying images on panels with dimming control, in a viewing environment with variable ambient light.

BACKGROUND

As used herein, the term 'dynamic range' (DR) may relate to a capability of the human visual system (HVS) to perceive a range of intensity (e.g., luminance, luma) in an image, e.g., from darkest grays (darks or blacks) to brightest whites (highlights). In this sense, DR relates to a 'scene-referred' intensity. DR may also relate to the ability of a display device to adequately or approximately render an intensity range of a particular breadth. In this sense, DR relates to a 'display-referred' intensity. Unless a particular sense is explicitly specified to have particular significance at any point in the description herein, it should be inferred that the term may be used in either sense, e.g. interchangeably.

As used herein, the terms "display management" or "display mapping" denote the processing (e.g., tone and gamut mapping) required to map images or pictures of an input video signal of a first dynamic range (e.g., 1000 nits) to a display of a second dynamic range (e.g., 500 nits). Examples of display management processes can be found in PCT Patent Application Ser. No. PCT/US2016/013352 (to be referred to as the '352 application), filed on Jan. 14, 2016, titled "Display management for high dynamic range images," which is incorporated herein by reference in its entirety.

In a typical content creation pipeline, video is color graded in an ambient environment of 5 nits. In practice, viewers may display content in a variety of ambient environments, say, at 5 nits (e.g., watching a movie in a dark home theater), at 100-150 nits (e.g., watching a movie in a relatively bright living room), or higher (e.g., watching a movie on a tablet in a very bright room or outside, in daylight).

As appreciated by the inventors here, improved techniques for the display of high-dynamic range images, especially as they relate to a changing viewing environment, are desired.

The approaches described in this section are approaches that could be pursued, but not necessarily approaches that have been previously conceived or pursued.

Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF THE DRAWINGS

An embodiment of the present invention is illustrated by way of example, and not in way by limitation, in the figures of the accompanying drawings and in which like reference numerals refer to similar elements and in which.

DESCRIPTION OF EXAMPLE EMBODIMENTS

Figure 1:
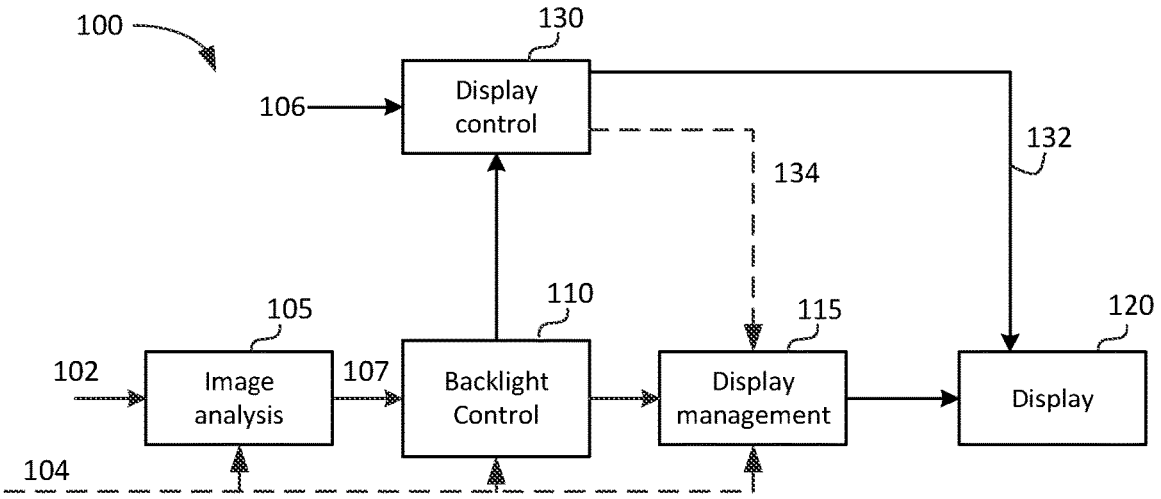
FIG. 1 depicts an example process for backlight control and display management.

Techniques for ambient-light adaptive display management or display mapping of images are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Overview

Example embodiments described herein relate to the display management of images under changing viewing environments (e.g., a change of the ambient light). In an embodiment, given an input image, image metadata, an ambient-light signal, and parameters characterizing a target display, a processor generates an ambient-light adjustment function mapping input luminance values in a reference viewing environment to output luminance values in a target viewing environment, wherein the target viewing environment is determined based on the ambient-light signal. The ambient-light adjustment function is applied to the input image and the input metadata to generate a virtual image and new metadata. A tone-mapping function based on the new metadata and the target display parameters is applied to the virtual image to generate an output image.

In an embodiment of a method for ambient-light-adaptive display management with a processor, the method comprises:

receiving an input image, metadata related to the input image, and an ambient-light signal, wherein the metadata comprises at least one of a minimum luminance value, a midpoint luminance value and a maximum luminance value of the input image;

obtaining, e.g. by receiving, selecting or generating, an ambient-light adjustment function which maps input luminance values in a reference viewing environment to output luminance values in a target viewing environment, wherein the target viewing environment is determined based on the ambient-light signal;

applying the ambient-light adjustment function to the input image to generate a virtual image, and to said at least one of the minimum, midpoint and maximum luminance value to generate new metadata for the virtual image;

obtaining, e.g. by receiving, selecting or generating, a tone-mapping function based on the new metadata and parameters for a target display; and applying the tone-mapping function to the virtual image to generate an output image for the target display.

In another embodiment, given an input image, image metadata, an ambient-light signal, and parameters characterizing a target display, a processor generates an ambient-light adjustment function mapping input luminance values in a reference viewing environment to output luminance values in a target viewing environment, wherein the target viewing environment is determined based on the ambient-light signal. The ambient-light adjustment function is applied to the input metadata to generate new metadata. A first tone-mapping function based on the new metadata and the target display parameters is generated. A second tone-mapping function based on the ambient-light adjustment function and the first tone-mapping function is generated, and the second tone-mapping function is applied to the input image to generate an output image to be displayed on the target display.

In an embodiment of a method for ambient-light-adaptive display management with a processor, the method comprises:

receiving an input image, metadata related to the input image, and an ambient-light signal, wherein the metadata comprises at least one of a minimum luminance value, a midpoint luminance value and a maximum luminance value of the input image;

obtaining, e.g. by generating, selecting or receiving, an ambient-light adjustment function which maps input luminance values in a reference viewing environment to output luminance values in a target viewing environment, wherein the target viewing environment is determined based on the ambient-light signal;

applying the ambient-light adjustment function to said at least one of the minimum, midpoint and maximum luminance value, to generate new metadata;

obtaining, e.g. by generating, selecting or receiving, a first tone-mapping function based on the new metadata and parameters for a target display;

obtaining, e.g. by generating, selecting or receiving, a second tone-mapping function based on the ambient-light adjustment function and the first tone-mapping function; and applying the second tone-mapping function to the input image to generate an output image for the target display.

The ambient-light adjustment function may for example be generated by the processor, or selected from a set of predefined ambient-light adjustment functions, wherein a different ambient-light adjustment function is defined for different ambient-light signals, i.e. for different levels of ambient light.

The tone mapping function and the first tone mapping function described above may for example be generated by the processor, or selected from a set of predefined tone mapping functions, wherein a different tone mapping function is selected for different values of the new metadata and the parameters for the target display.

The parameters characterizing the target display are for example computed based on the ambient-light signal, global dimming metadata, and luminance characteristics of the target display.

In an embodiment, an apparatus comprises a display manager for mapping an image having a first dynamic range to a second dynamic range of a target display, a processor and an ambient-light sensor providing an ambient-light signal. The display manager is configured to:

receive a first image and metadata related to the first image, the metadata comprising at least one of a minimum luminance value, a midpoint luminance value and a maximum luminance value of the first image;

obtain a tone-mapping function based on the metadata related to the first image and parameters for the target display; and apply the tone-mapping function to the first image to generate an output image for the target display.

The processor is configured to:

receive an input image and metadata related to the input image comprising at least one of a minimum luminance value, a midpoint luminance value and a maximum luminance value of the input image;

obtain an ambient-light adjustment function which maps input luminance values in a reference viewing environment to output luminance values in a target viewing environment, wherein the target viewing environment is determined based on the ambient-light signal of the ambient light sensor;

apply the ambient-light adjustment function to the input image to generate a virtual image, and to said at least one of the minimum, midpoint and maximum luminance value of the metadata of the input image to generate new metadata for the virtual image; and output the virtual image and the new metadata to the display manager.

The processor therefore generates a virtual image and new metadata that is output to the display manager. The display manager then takes the virtual image and new metadata as input, obtains a tone-mapping function based on the new metadata and parameters for the target display, and applies the tone-mapping function to the virtual image to generate an output image for the target display. Therefore, the processor applies an ambient-light correction to the input image before the display manager maps the data into the target display. This allows the processing of the display manager to remain unaltered. For example, the display manager may be implemented already in hardware that has been deployed in devices without ambient light control.

Example Display Control and Display Management

FIG. 1 depicts an example process (100) for display control and display management according to an embodiment. Input signal (102) is to be displayed on display (120). Input signal may represent a single image frame, a collection of images, or a video signal. Image signal (102) represents a desired image on some source or master display typically defined by a signal electro-optical transfer function (EOTF), such as ITU-R BT. 1886 (also referred to as "gamma mapping") or SMPTE ST 2084 (also referred to as "PQ mapping"), which describes the relationship between color values (e.g., luminance) of the input video signal to output screen color values (e.g., screen luminance) produced by the target display (120). The display may be a movie projector, a television set, a monitor, and the like, or may be part of another device, such as a tablet or a smart phone.

Process (100) may be part of the functionality of a receiver or media player connected to a display (e.g., a cinema projector, a television set, a set-top box, a tablet, a smart-phone, a gaming console, and the like), where content is consumed, or it may be part of a content-creation system, where, for example, input (102) is mapped from one color grade and dynamic range to a target dynamic range suitable for a target family of displays (e.g., televisions with standard or high dynamic range, movie theater projectors, and the like).

In some embodiments, input signal (102) may also include metadata (104). As used herein, the term "metadata" relates to any auxiliary information that is transmitted as part of the coded bitstream and assists a decoder to render a decoded image. Such metadata may include, but are not limited to, color space or gamut information, reference display parameters, and auxiliary signal parameters, as those described herein. These can be signal metadata, characterizing properties of the signal itself, or source metadata, characterizing properties of the environment used to color grade and process the input signal (e.g., source display properties, ambient light, coding metadata, and the like).

In some embodiments (e.g., during content creation), process 100 may also generate metadata which are embedded into the generated tone-mapped output signal. A target display (120) may have a different EOTF than the source display. A receiver needs to account for the EOTF differences between the source and target displays to accurate display the input image, so that it is perceived as the best match possible to the source image displayed on the source display. In an embodiment, image analysis (105) block may compute characteristics of the input signal (102), such as its minimum (min), average (mid), and peak (max) luminance values, to be used in the rest of the processing pipeline. For example, given min, mid, and max luminance source data (107 or 104), image processing block (110) may compute the display parameters (e.g., the preferred backlight level for display (120)) that will allow for the best possible environment for displaying the input video. Display management (115) is the process that maps the input image into the target display (120) by taking into account the two EOTFs as well as the fact that the source and target displays may have different capabilities (e.g., in terms of dynamic range).

In some embodiments, the dynamic range of the input (102) may be lower than the dynamic range of the display (120). For example, an input with maximum luminance of 100 nits in a Rec. 709 format may need to be color graded and displayed on a display with maximum luminance of 1,000 nits. In other embodiments, the dynamic range of input (102) may be the same or higher than the dynamic range of the display. For example, input (102) may be color graded at a maximum luminance of 5,000 nits while the target display (120) may have a maximum luminance of 1,500 nits.

In an embodiment, display (120) is controlled by display controller (130). Display controller (130) provides display-related data (134) to the display mapping process (115) (such as: minimum and maximum luminance of the display, color gamut information, and the like) and control data (132) for the display, such as control signals to modulate the backlight or other parameters of the display for either global or local dimming.

In an embodiment, display controller (130) may receive information (106) about the viewing environment, such as the intensity of the ambient light. This information can be derived from measurements from one or more sensors attached to the device, user input, location data, default values, or other data. For example, even without a sensor, a user could select a viewing environment from a menu, such as "Dark", "Normal", "Bright," and "Very bright," where each entry in the menu is associated with a predefined luminance value selected by the device manufacturer. Alternatively, an estimate of the ambient light could be based on the time of day. Signal 106 may also include estimates of the screen reflections in the viewing environment. Such estimates may be derived from a model of the screen reflectivity of the display (120) and measurements of the ambient light in the viewing environment. Typically, sensors are in the front of the display and measure the illumination on the display screen, which is the ambient component that elevates the black level as a function of reflectivity. Viewing environment information (106) may also be communicated to display management unit (115) via interface 134.

Displays using global or local backlight modulation techniques adjust the backlight based on information from input frames of the image content and/or information received by local ambient light sensors. For example, for relatively dark images, the display controller (130) may dim the backlight of the display to enhance the blacks. Similarly, for relatively bright images, the display controller may increase the backlight of the display to enhance the highlights of the image, as well as elevate the luminance of the dark regions since they would fall below threshold contrasts for a high ambient environment.

Backlight Control

Figure 2:
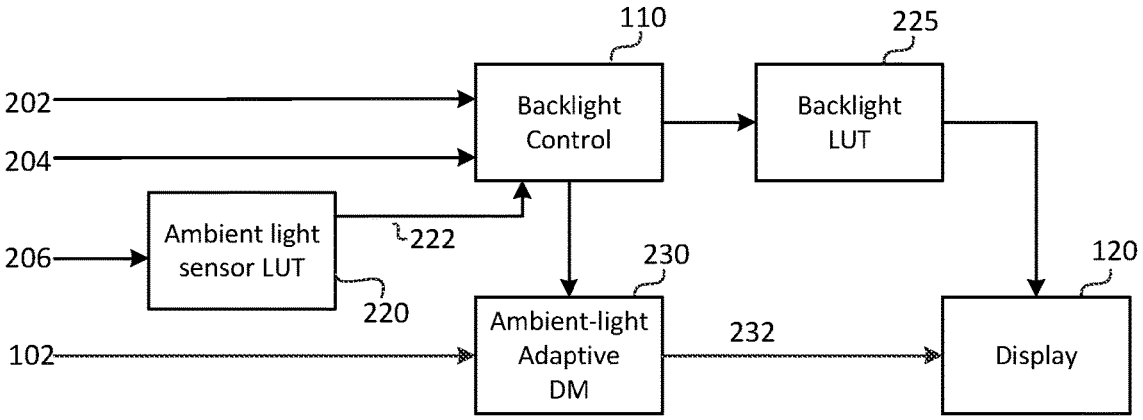
FIG. 2 depicts an example process for backlight control and ambient-light-adaptive display management according to an embodiment of this invention.

In an embodiment, display (120) may support backlight control via global or local dimming. FIG. 2 depicts an example process of backlight control and ambient light-adaptive display management according to an embodiment. FIG. 2 is very similar to FIG. 1, but depicts additional processing details and signals related to backlight control (110).

As depicted in FIG. 2, in some embodiments, metadata (202) related to global dimming control may be received as part of metadata (104) either in the bitstream or the HDMI input data. In some embodiments, the global dimming metadata (202) may be computed from the source input (102) in the image analysis block (105). As an example, and without limitation, in an embodiment, backlight control metadata may define two global dimming control variables, to be denoted as anchor_PQ and anchor_power. For example, anchor_PQ may describe a metric of the image content (e.g., min, mid. (average) or max luminance values), and anchor_power may describe some other parameter of the image content (e.g., standard deviation of luminance), describing the amount of deviation from anchor_PQ, to help guide setting the backlight and other display parameters. For example, for normalized luminance values in (0,1), the input values for these variables may be: anchor_PQ=0.4 and anchor_power=0.2.

Denote as target_backlight the peak luminance of the target display (120) to display the input image. Its value will determine the power required to drive the display's backlight via the global or local dimming controls.

Display (120) may also allow for a user-adjusted brightness control which allows a user to guide or overwrite default picture display settings. As an example, and without limitation, user-adjusted brightness may be determined via a user_brightness variable (204), typically taking values between 0 and 100%.

Display (120) may include an ambient light sensor which outputs some digital code (206) corresponding to the amount of incident light. This value may be passed to an ambient-light calibration LUT (220) which outputs the corresponding actual luminous flux (LUX) (for example, denoted by variable ambient_lux (222)). Alternatively, the output of the ambient-light LUT could be given directly in luminance units (e.g., nits), thus eliminating the need to compute surround luminance based on luminous flux and reflections. The calibrated response of the ambient light sensor may be scaled by the user preference adjustment. This may be less than 100%, to dim the panel, or greater than 100%, to make the panel brighter. The result is input to the backlight computation algorithm along with the global dimming metadata.

In an embodiment, the backlight computation algorithm combines the inputs from metadata (202), user control (204), and the light sensor (206) to determine the appropriate backlight brightness. An example algorithm is given by the following pseudo-code.

```
target_backlight=anchor_pq*anchor_pq_weight+
    anchor_power*anchor_power_weight;
adjusted_backlight=target_backlight*user_brightness
    *amb_gain*(ambient_lux*ambient_reflections−ambi-
    ent_offset);
clamped_backlight=max(backlight_min*half_contrast,
    min(backlight_max/half_contrast,  adjusted_back-
    light));
target_display_max=clamped_backlight*half_contrast;
target_display_min=clamped_backlight/half_contrast;
```

anchor_pq_weight and anchor_power_weight denote weighting coefficients to scale the metadata, typically 1 and 0.5 respectively.

amb_gain, ambient_reflections, and ambient_offset are weighting coefficient and bias to scale the readings from the ambient light sensor, typically 0.01, 0.2/π, and 5 respectively.

half_contrast, backlight_min and backlight_max are determined based on the backlight capabilities and the contrast ratio. For example if the panel has a 1,000:1 contrast ratio, then the contrast is $10^{(log_{10}(1000)/2)}=\sqrt{1000}=31.6$. If the minimum black level is 0.1 nits, and peak brightness is 600 nits, then the clamped backlight will be clamped between 600/31.6=18.97 and 0.1*31.6=3.16 nits.

The resulting target_display_min and target_display_max are then used in the ambient-light adaptive display management computations unit (230) to generate an output image (232).

The target_display_max value is also passed to a backlight look up table (LUT) (225) which converts the desired backlight luminance value into the appropriate backlight control value. For example, this LUT may be populated from measurements of corresponding control values and measured luminance.

In an alternative embodiment, the term

```
amb_gain*(ambient_lux*ambient_reflections−ambient-
    _offset)
```

for adjusting the backlight level to the light level sensed by the ambient light sensor is absorbed into the metadata anchor_pq (representing min, mid or max luminance) and anchor_power. In other words, new metadata is generated based on the ambient light level:

```
anchor_pq_new=anchor_pq*amb_gain*
    (ambient_lux*ambient_reflections−ambient_offset)
anchor_power_new=anchor_power*amb_gain*
    (ambient_lux*ambient_reflections−ambient_offset)
```

The backlight is then adjusted by the display management process as follows:

```
target_backlight=anchor_pq_new*anchor_pq_weight+
    anchor_power_new*anchor_power_weight;
adjusted_backlight=target_backlight*user_brightness
clamped_backlight=max(backlight_min*half_contrast,
    min(backlight_max/half_contrast,  adjusted_back-
    light));
target_display_max=clamped_backlight*half_
    contrasttarget_display_min=clamped_backlight/
    half_contrast.
```

Ambient-Light-Adaptive Display Management

Figure 3A:
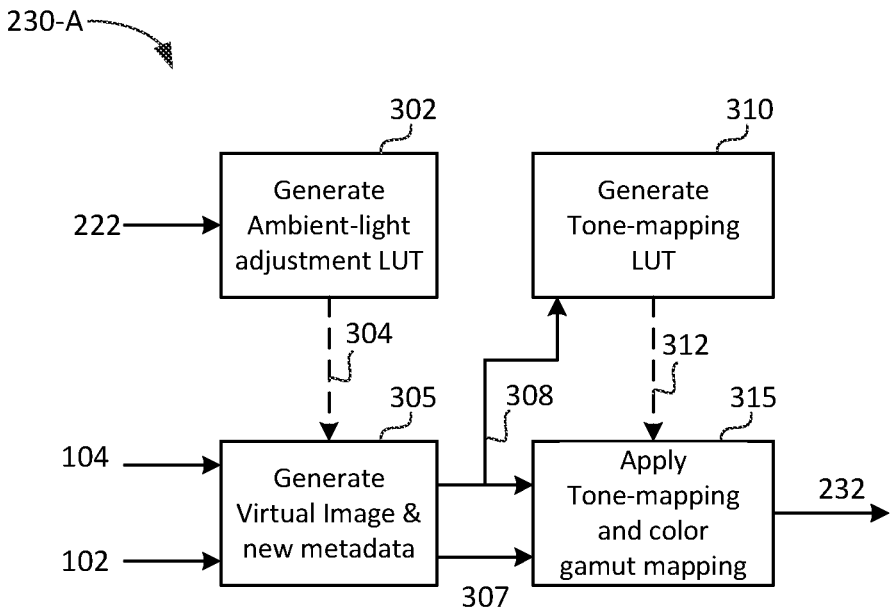
FIG. 3A and FIG. 3B depict example processes for ambient-light-adaptive display management according to embodiments of this invention.
Figure 3B:
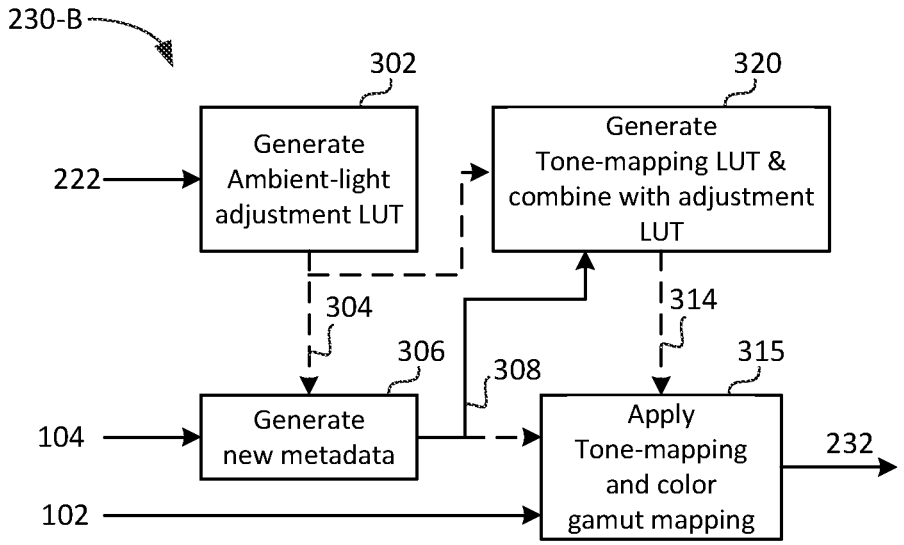

FIG. 3A and FIG. 3B depict in more detail example processes for the ambient-light adaptive display management process (230) according to two embodiments. These processes (230-A, 230-B) combine the traditional "ambient-light-independent" display management operations of tone mapping and color gamut mapping (315) (e.g., as the one described in the '352 application) with additional steps which adjust the source image (102) and the source metadata (104) according to the conditions of the viewing environment (222).

One of the novelties in this embodiment is applying an ambient-light correction to the source image data (102) before mapping the data into the target display. This allows for the display mapping process (315) to remain constant despite changes in the viewing environment. For example, the display management process (315) may be implemented already in hardware that has been deployed in devices without ambient light control. Then, with new software, the same hardware may be adapted to be used in devices with ambient light control as well. Generating a virtual image and adjusting the source metadata, in combination with the backlight control discussed earlier, allows for optimum viewing on the target display, regardless of the surrounding ambient light. The specific steps in the two example embodiments of process 230 are discussed next.

Ambient-Light Correction of the Source Input

One may compensate for the surrounding ambient light by taking into account aspects of the human visual system. Environments with higher ambient light require higher contrast in the blacks, to increase perceptually crushed black detail, and higher peak whites (highlights), to maintain the same visual appearance of brightness. The opposite is true for a darker ambient environment. Ambient-light adjustment should be used to compensate for viewing environments that differ from a reference viewing environment (e.g., 5 nits).

As depicted in FIG. 3A, in an embodiment (230-A), given information (222) related to the viewing environment, in step (302), the display management process generates or selects from a set of pre-computed luminance mappings, a mapping for compensating and/or adjusting for the surrounding ambient light. For example, such a mapping may be expressed as an ambient-light compensation or adjustment LUT (304). Examples of ambient-light-compensation functions (304) are provided in FIG. 4 for four possible viewing environments: at 5 nits (405), 100 nits (410), 500 nits (415), and zero nits (420). In an embodiment, without limitation, these plots are derived based on the methods described in U.S. patent application Ser. No. 15/298,521 (the '521 application), "Ambient-Light-Corrected Display Management for High Dynamic Range Images," by. R. Wanat et al., filed on Oct. 20, 2016, which is incorporated herein by reference in its entirety.

Figure 4:
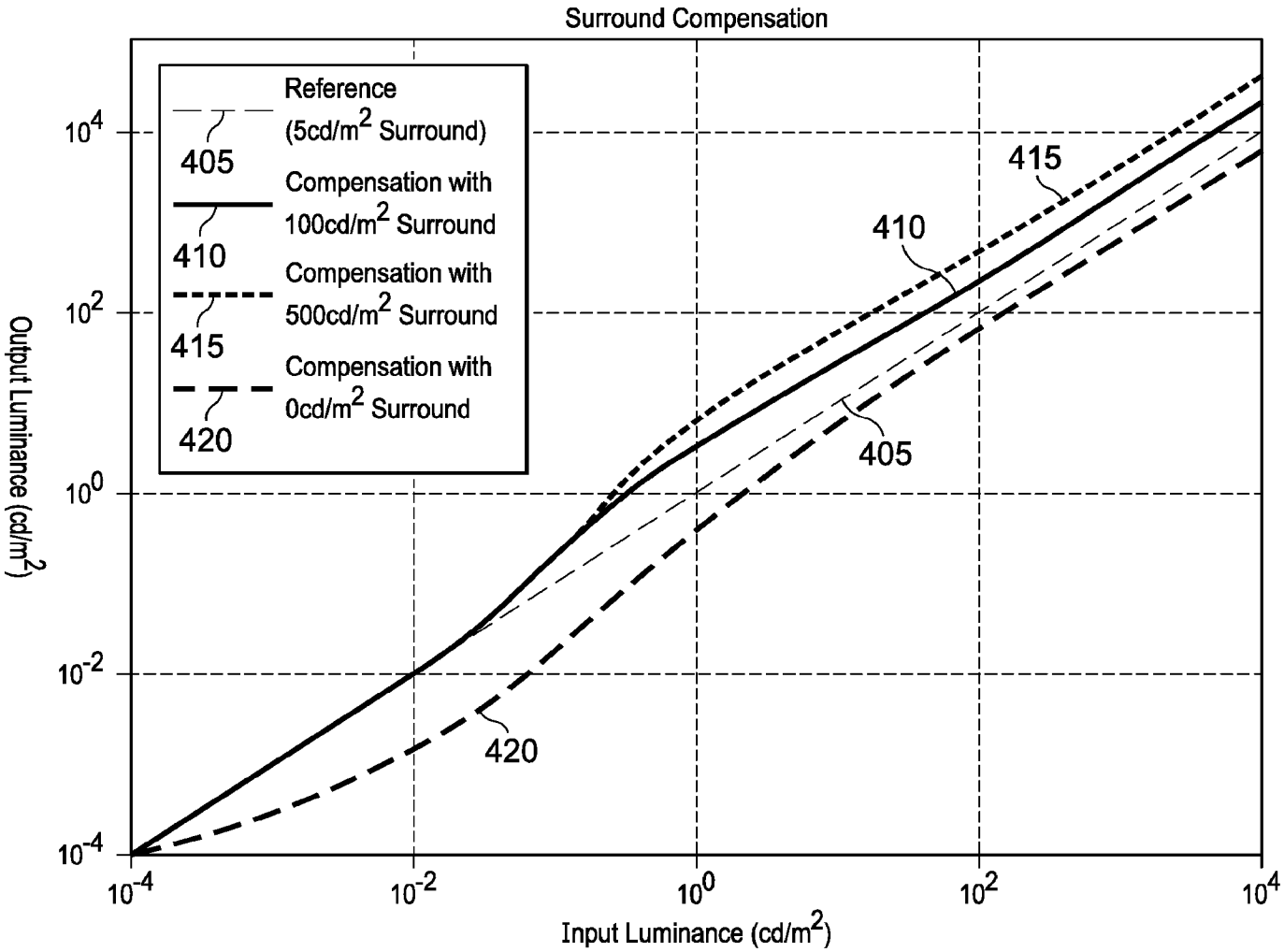
FIG. 4 depicts example functions for ambient-light surround compensation according to an embodiment of this invention.

As depicted in FIG. 4, when the viewing environment matches the reference environment (e.g., 5 nits), function 405 represents a straight line with slope=1, that is, no adjustment is needed. For darker (e.g., 420) or brighter (e.g., 410, 415) viewing environments, the input luminance is either decreased or increased as needed.

Similar surround ambient-light compensation mappings may be derived for other viewing environments using either analytical (e.g., see the '521 application) or interpolation techniques. For example, given pre-computed curves $f_{L,m1}$ (I) and $f_{L,m2}$ (I) for two ambient-light values, m1 and m2, a new curve $f_{L,m1}$(I) for m1<m<m2 may be generated by interpolating between the $f_{L,m1}$(I) and $f_{L,m2}$(I) values.

Given the ambient-light adjustment LUT (304), in step (305), this LUT is applied to the input image (102) to generate a virtual image (307). The virtual image represents an image that was generated in an environment matching the viewing environment, thus traditional display management techniques (which don't take into consideration the surrounding ambient light) can now be applied directly to the virtual image.

In an alternate embodiment, the amount of surround compensation to be applied may also be dependent on the image content. For example, the metadata describing the source image average luminance may be used to adjust the amount of ambient compensation to apply. For very dark images the amount of compensation could be high (full strength) because there is a lot of dark detail present that must be preserved. However for bright images the amount of compensation may be reduced, which may reduce the visibility of the dark detail but improve the overall image contrast and appearance.

Source Metadata Adjustment

As described in the '352 application, the display mapping process (115) may be improved by providing source metadata, such as the source min, mid, and max luminance values, to guide the process. Since the source image 102 has been adjusted for a specific viewing environment, the source metadata (104) need to be adjusted as well. In an embodiment, this step (305) may be performed by mapping the source metadata (104) to updated or new metadata values (308) using the same ambient-light adjustment function or LUT (304) as the one used in to generate the virtual image 307.

Display Mapping

As described in the '352 application, display mapping involves tone mapping (to map up or down the brightness levels) and gamut mapping (to map the colors of the input image into the color volume of the target display). For example, in step (310), following the techniques described in the '352 application, a sigmoid tone-mapping curve (312) may be generated using the min, mid, and max luminance values of the signal to be tone mapped and the min and max luminance values of the target display (e.g., the target_display_min and target_display_max values computed earlier). Given the tone-mapping curve (312), in step (315), the output image (232) is generated by applying tone mapping and color gamut mapping.

Traditional tone-mapping techniques assume that the source and the target displays are in the similar ambient-light environments. By applying steps (302) and (305), the core display mapping algorithms (e.g., 310 and 315) may remain the same regardless of the techniques used for ambient-light compensation, thus simplifying the design and supporting interoperability with existing software and hardware.

Combined Ambient-Light-Compensation and Tone-Mapping

As depicted in FIG. 4, the ambient-light-adjustment LUT (304), e.g., the one generated in step (302), maps input luminance values ($I_{in}$) to luminance values of the virtual image ($I_v$), e.g. $I_v$=($I_{in}$). Next, during tone-mapping, the luminance values of the virtual image ($I_v$) are mapped to output luminance values ($I_o$) of signal (232) to be displayed to the target display. This may be expressed as $I_o$=$f_T$($I_v$), where $f_T$(•) denotes the tone-mapping function (312) generated in step (310). As depicted in process (230-B), in an embodiment, in step (320), the two mapping functions ($f_L$(•) and $f_T$(•)) may be combined into one to generate a combined mapping function (or LUT) $f_{LT}$(•) (314), such that $I_o$=$f_{LT}$($I_{in}$). To generate a proper $f_T$(•), the input metadata (104) still need to be remapped to adjusted metadata (308) using the $f_L$(•) mapping (304). As depicted in step (306), which generates the adjusted metadata values (308), this embodiment eliminates the need to generate the full virtual image (307), thus reducing the storage requirements and overall computation resources.

Luminance Adjustment Based on Preserving Perceptual Contrast

The SMPTE ST 2084 mapping, which is also commonly referred to as the perceptual quantization (PQ) mapping, was designed for 12-bits input data to have "just-imperceptible" step sizes, that is, a single step from two adjacent code words would not be noticeable to a standard observer. This design utilized "best case human visual system" analysis, where the observer would theoretically be adapted to every luminance level. This way, regardless of the viewing conditions, quantization artifacts would never be visible. In practice, there are viewing conditions where it is not possible for the observer to adapt to every luminance level. For example, in a bright room, an observer may not be able to adapt to dark luminance levels on a display, like a TV, a tablet, or a mobile phone.

As described earlier, before applying display management operations (115), in an embodiment, it may be beneficial to apply an ambient-light adjustment curve to incoming input data to compensate for the surrounding ambient light.

Figure 5:
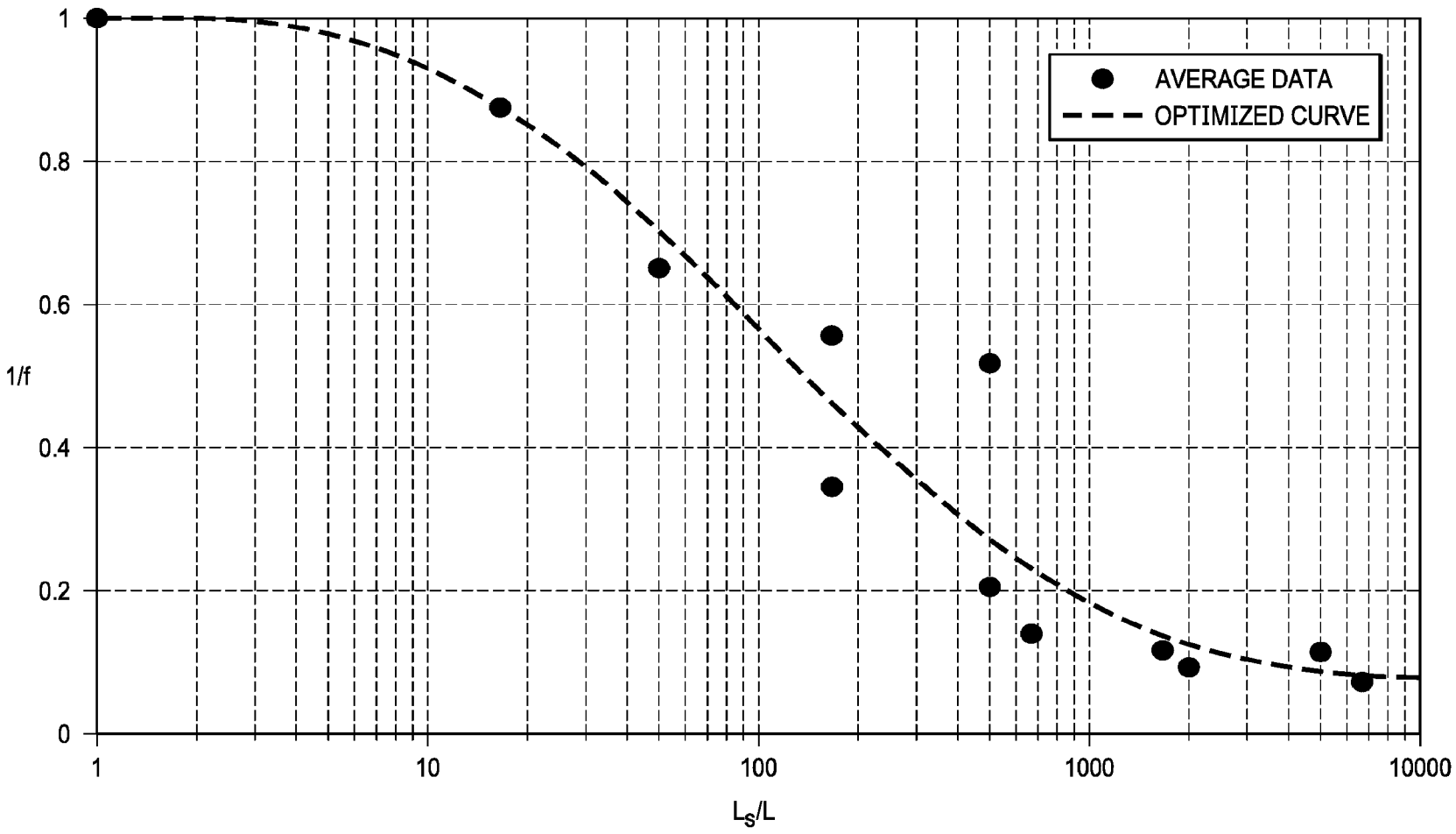
FIG. 5 depicts an example relationship between a ratio of surround ambient luminance over signal luminance and a contrast scaling function to maintain perceptual contrast under surround ambient luminance according to an embodiment of this invention.

Let adjusted contrast be defined as $$c' = c * f = \frac{Lmax - Lmin}{Lmax + Lmin} * f, \tag{1}$$

where $f$ is a scale factor to adjust contrast (c) according to surround ambient luminance so that the perceived contrast in the original image is preserved, and Lmin and Lmax denote the upper and lower luminance values of one 12-bit step in the input signal quantizer (e.g., PQ). If $f$=1, then there is no need to adjust the contrast. In an embodiment, $f$ was determined as a function of surround luminance based on a psychophysical experiment, where for various test ambient luminance levels, the optimal contrast value was determined so that an observer adapted to the test ambient luminance level could again "just" detect a difference between adjacent codewords of adjusted luminance levels. FIG. 5 depicts example results of the test for various values of $L_S$/L values, where L denotes input luminance and $L_S$ denotes ambient surround luminance. In an embodiment, without limitation, $f$ may be approximated as $$f = 1 \Big/ \left(0.93e^{\frac{-\ln\left(\frac{L_S}{L}\right)^3}{155}} + 0.07\right), \tag{2}$$

A person skilled in the art would appreciate that $f$ or $1/f$ may be represented by alternative representations, e.g., a table look-up (LUT), a piecewise linear function, a piecewise non-linear function, splines, and the like.

Figure 6:
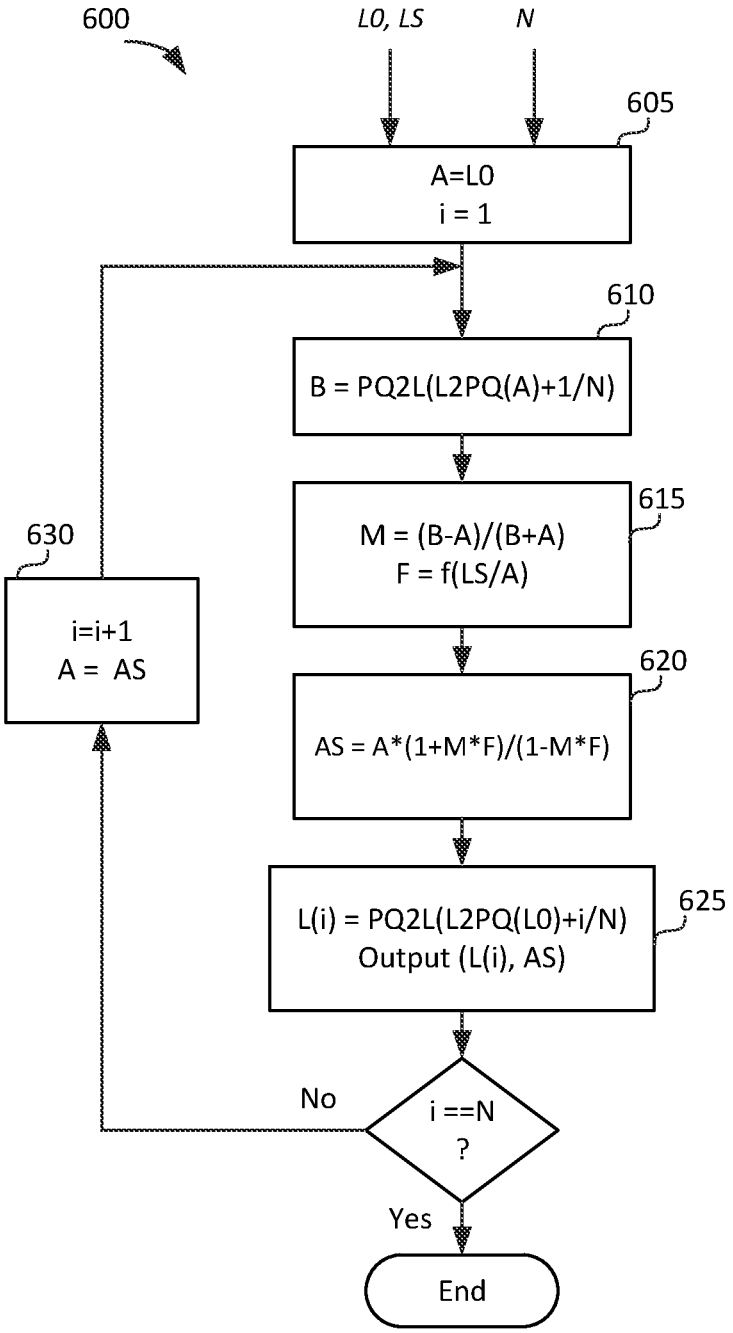
FIG. 6 depicts an example process for ambient-light-based adaptation of the PQ function according to an embodiment of this invention.

Given a mapping of $L_S/L$ values to the contrast scaling values (e.g., function $f(L_S/L)$ in equation (2)), FIG. 6 depicts an example process (600) for computing an input to output luminance adjustment mapping according to an embodiment. While an example herein is provided for input images that are coded using the PQ mapping function, a person skilled in the art would appreciate that a similar method may be applied to alternative signal quantization functions, such as the traditional gamma function, the Hybrid-Log-gamma function (see BT. 2100), and the like.

Input to the process are: L0, an initial luminance value (e.g., 0.001 nits), LS, the ambient surround luminance (e.g., 100 nits), and N, the number of quantization steps in normalized PQ space (e.g., (0, 1)) of the input luminance space (e.g., 0.001 to 10,000 nits). In an example embodiment, N=4,096 provides a good trade-off between accuracy, storage requirements, and computational load. Step 605 is an initialization step for variable A, setting A=L0. Given luminance value A in linear space (e.g. in nits), step 610 computes the luminance of the next codeword (B) at a distance of 1/N in the quantized (e.g. PQ) space, by: a) converting the A value to PQ space using the linear-to-PQ function L2PQ( ) b) adding the PQ step 1/N, and c) then generating a value (B) back to linear space by applying to the sum a PQ-to-linear function PQ2L( ). For PQ-coded signals, the L2PQ0 and PQ2L( ) transfer functions are described at least in Rec. ITU-R BT.2100, *"Image parameter values for high dynamic range television for use in production and international programme exchange,"* (July 2016), which is incorporated herein by reference.

Given the two consecutive luminance values, A and B, step 615 computes using equation (1) the local contrast value (M) assuming no adjustment is needed (e.g., $f$=1). For $L_S/L$=LS/A, it also computes the contrast scale factor F=$f$(LS/A) using equation (2). Given the M and F values, from equation (1), step 620 computes the desired (normalized) output luminance value (AS) as $$AS = A\frac{(1 + M * F)}{(1 - M * F)}. \tag{3}$$

In step (625), luminance values of L(i)=PQ2L(L2PQ(L0)+i/N) and corresponding AL(i)=AS values may be used to generate a luminance adjustment look-up table (L(i), AL(i)). Steps 610-625 are repeated N times to cover the full input dynamic range. Note that after each iteration (step 630), the output value AS becomes the new input A. Note that for i=0, L0 is simply mapped to L0.

Figure 7:
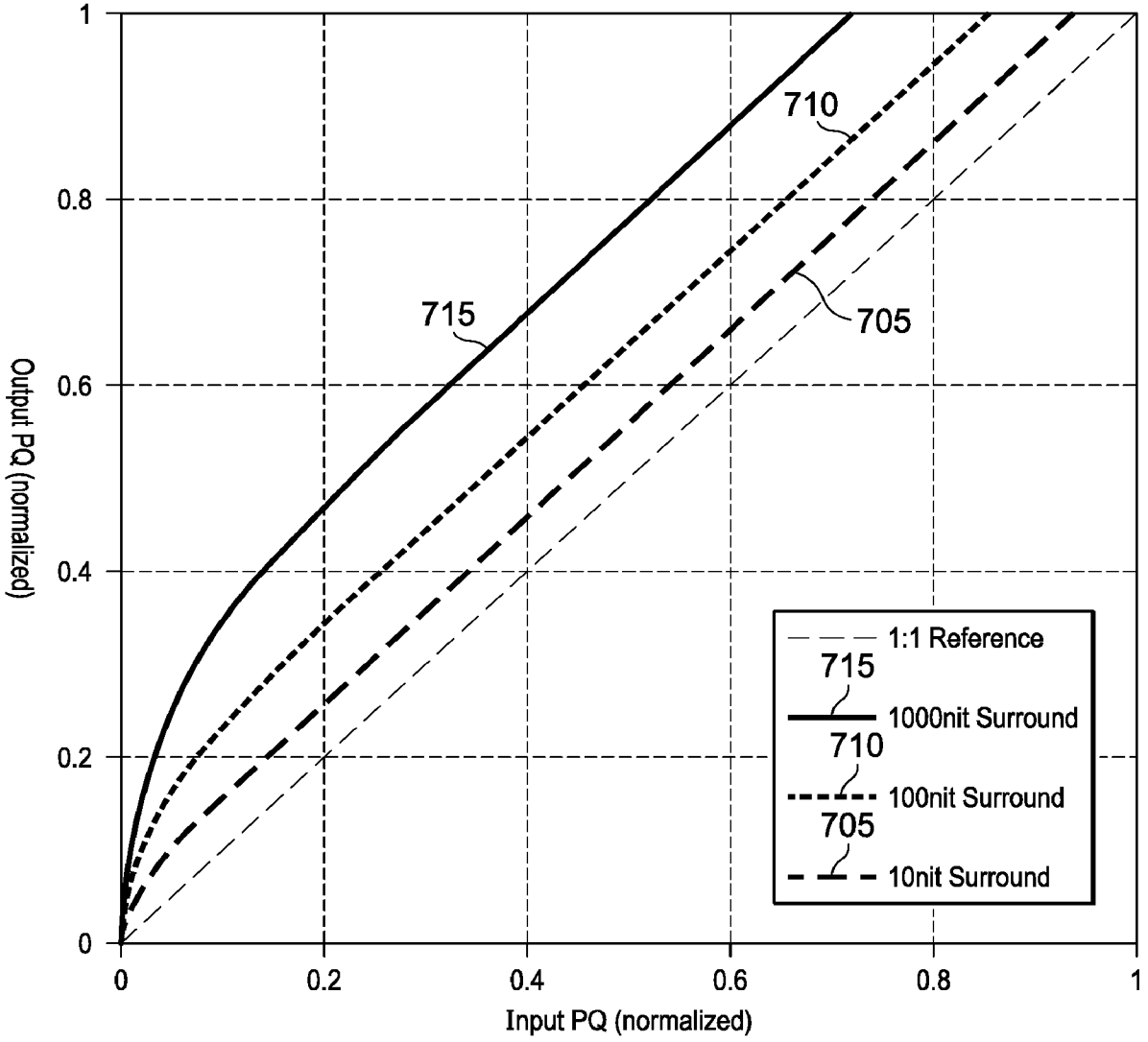
FIG. 7 depicts examples of input PQ to output PQ mappings adapted for surround ambient luminance computed according to an embodiment of this invention.

FIG. 7 depicts examples of three luminance adaptation curves (705, 710, 715), as computed using the process of FIG. 6, for surround ambient light at 10, 100, and 1,000 nits.

In an embodiment, the luminance adaptation curves computed by process 600, also known as ambient-light adjustment functions, may be expressed using a parametric representation. For example, for the PQ function, $$f(L, L_S) = L - \left(-a(L_S)e^{-(L)^{b(L_S)\times(210.6b(L_S)-128.8)}} + a(L_S)\right), \tag{4a}$$

where $$a(L_S) = 0.1959 - 0.1697e^{L_S/0.7359},$$
$$b(L_S) = 0.6555 + 0.1646e^{-L_S/0.2077}. \tag{4b}$$

In an embodiment, the ambient-light adjustment function is the identity function when ambient light intensity in the target viewing environment is the same as in the reference viewing environment. Further, at least for input values greater than the minimum input value (e.g. zero) and smaller than the maximum input value (e.g. one), the output values of the ambient-light adjustment function are greater than the input values when ambient light intensity in the target viewing environment is higher than ambient light intensity in the reference viewing environment. On the other hand, the output values of the ambient-light adjustment function are lower than the input values when ambient light intensity in the target viewing environment is lower than ambient light intensity in the reference viewing environment, at least for input values greater than the minimum input value (e.g. zero). Optionally, the minimum input value (e.g. zero) may be mapped to a minimum output value (e.g. zero), independent of the ambient light intensity.

In a further example, when ambient light intensity in the target viewing environment is greater than ambient light intensity in the reference viewing environment, an upper range of input values may be mapped to the maximum output value, i.e. the output value of the ambient-light adjustment function may be clipped to the maximum output value (e.g. one) for all input values exceeding a predetermined threshold, wherein this threshold decreases for increasing ambient light intensity.

In an embodiment, in case the ambient light intensity in the target viewing environment is higher than ambient light intensity in the reference viewing environment, the ambient-light adjustment function can be defined according to three adjoining ranges of input values: a lower range, a midrange and an upper range. The lower range starts at zero. At an input value equal to zero, the output value of the ambient-light adjustment function equals zero. For the other input values in the lower range, i.e. the input values in the lower range greater than zero, the output value is greater than the input value. Further, in the lower range, the ambient-light adjustment function has a slope that is decreasing as input values increase. In the midrange, the ambient-light intensity function is linear, having a slope equal to one and an intercept greater than zero, or at least approximates such a linear function. In the upper range, the output values of the ambient-light adjustment function are clipped to the maximum output value (e.g. one).

On the other hand, in case the ambient light intensity in the target viewing environment is lower than ambient light intensity in the reference viewing environment, the ambient-light adjustment function can be defined according to two adjoining ranges: a lower range and an upper range. The lower range starts at zero. At an input value equal to zero, the output value of the ambient-light adjustment function equals zero. For the other input values in the lower range, i.e. the input values in the lower range greater than zero, the output value is smaller than the input value. Further, the slope of the ambient-light adjustment function in the lower range decreases for increasing input values. In the upper range, the ambient-light intensity function is linear, having a slope equal to one and an intercept smaller than zero, or at least approximates such a linear function.

These functions may also be applied to convert from one surround luminance condition to another. For example, given a reference ambient light R, consider $y_R^{10}(L)=LUT_R10(L)$ a look-up table generating adjusted values for ambient light of 10 nits (e.g., 705). Consider $y_R^{100}=LUT_R100(L)$ a look-up table generating adjusted values for ambient light of 100 nits (e.g., 710). Then, to generate a new LUT, from 10 nits to 100 nits, one can simply map the $y_R^{10}(L)$ values to the $y_R^{100}(L)$ values. That is, if $L_{out}=y_R^{10}(L)$, then $y_{10}^{100}(L)=y_R^{100}(L_{out})=y_R^{100}(y_R^{10}(L))$. L values not directly available from the $y_R^{10}(L)$ mapping may be interpolated from available values.

The ambient-light intensity function may increase the contrast in the darks, while maintaining the contrast in the brights.

By applying the ambient-light intensity function to the metadata, e.g. at least one of a minimum luminance value, a midpoint luminance value and a maximum luminance value, the backlight of a display can be controlled to adjust for ambient light.

Example Computer System Implementation

Embodiments of the present invention may be implemented with a computer system, systems configured in electronic circuitry and components, an integrated circuit (IC) device such as a microcontroller, a field programmable gate array (FPGA), or another configurable or programmable logic device (PLD), a discrete time or digital signal processor (DSP), an application specific IC (ASIC), and/or apparatus that includes one or more of such systems, devices or components. The computer and/or IC may perform, control, or execute instructions relating to ambient-light adaptive display management processes, such as those described herein. The computer and/or IC may compute any of a variety of parameters or values that relate to ambient-light adaptive display management processes described herein. The image and video embodiments may be implemented in hardware, software, firmware and various combinations thereof.

Certain implementations of the invention comprise computer processors which execute software instructions which cause the processors to perform a method of the invention. For example, one or more processors in a display, an encoder, a set top box, a transcoder or the like may implement methods related to ambient-light adaptive display management processes as described above by executing software instructions in a program memory accessible to the processors. The invention may also be provided in the form of a program product. The program product may comprise any non-transitory medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (e.g., that is functionally equivalent), including components which are not structurally equivalent to the disclosed structure which performs the function in the illustrated example embodiments of the invention.

EQUIVALENTS, EXTENSIONS, ALTERNATIVES AND MISCELLANEOUS

Example embodiments that relate to ambient-light adaptive display management processes are thus described. In the foregoing specification, embodiments of the present invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

Various aspects of the present invention may be appreciated from the following enumerated example embodiments (EEEs):

1. A method for ambient-light-adaptive display management with a processor, the method comprising:

receiving an input image, input image metadata, and an ambient-light signal;

generating an ambient-light adjustment function which maps input luminance values in a reference viewing environment to output luminance values in a target viewing environment, wherein the target viewing environment is determined based on the ambient-light signal;

applying the ambient-light adjustment function to the input image and the input metadata to generate a virtual image and new metadata for the virtual image;

generating a tone-mapping function based on the new metadata and parameters for a target display; and applying the tone-mapping function to the virtual image to generate an output image for the target display.

2. A method for ambient-light-adaptive display management with a processor, the method comprising:

receiving an input image, input image metadata, and an ambient-light signal;

generating an ambient-light adjustment function which maps input luminance values in a reference viewing environment to output luminance values in a target viewing environment, wherein the target viewing environment is determined based on the ambient-light signal;

applying the ambient-light adjustment function to the input metadata to generate new metadata;

generating a first tone-mapping function based on the new metadata and parameters for a target display;

generating a second tone-mapping function based on the ambient-light adjustment function and the first tone-mapping function; and applying the second tone-mapping function to the input image to generate an output image for the target display.

3. The method of EEE 1 or EEE 2, wherein the ambient-light adjustment function is the identity function when ambient light intensity in the target viewing environment is approximately the same as in the reference viewing environment.

4. The method of any preceding EEE, wherein in the ambient-light adjustment function, for one or more input luminance values, the corresponding output values are higher than the input values when ambient light intensity in the target viewing environment is higher than ambient light intensity in the reference viewing environment.

5. The method of any preceding EEE, wherein in the ambient-light adjustment function, for one or more input luminance values, the corresponding output values are lower than the input values when ambient light intensity in the target viewing environment is lower than ambient light intensity in the reference viewing environment.

6. The method of any preceding EEE, wherein the parameters for the target display comprise a target display minimum brightness value and a target display maximum brightness value.

7. The method of EEE 6, wherein computing the target display minimum brightness value and the target display maximum brightness value is based at least on the ambient light signal.

8. The method of EEE 7, wherein computing the target display minimum brightness value and the target display maximum brightness value comprises:

receiving one or more global dimming control parameters;

receiving a user-adjusted brightness control input;

receiving one or more parameters characterizing the target display; and determining the target display minimum brightness value and the target display maximum brightness value based on the global dimming control parameters, the user-adjusted brightness control input, the ambient light signal, and the one or more parameters characterizing the target display.

9. The method of EEE 8, further comprising, computing:

target_backlight=anchor_pq*anchor_pq_weight+anchor_power*anchor_power_weight;

adjusted_backlight=target_backlight*user_brightness*amb_gain*(ambient_lux*ambient_reflections−ambient_offset);

clamped_backlight=max(backlight_min*half_contrast, min(backlight_max/half_contrast, adjusted_backlight));

target_display_max=clamped_backlight*half_contrast;

target_display_min=clamped_backlight/half_contrast;

wherein anchor_pq and anchor_power are global dimming parameters, anchor_pq_weight, anchor_power_weight, amb_gain, ambient_reflections, ambient_offset, denote weighting coefficients, half_contrast, backlight_min and backlight_max are parameters characterizing the target display, and target_display_min and target_display_max denote respectively the target display minimum brightness value and the target display maximum brightness value.

10. The method of EEE 1, wherein generating the ambient-light adjustment function comprises:

accessing a contrast function to generate contrast values between two input luminance values when there is no need for ambient-light adjustment;

determining a contrast scaling function to scale the output of the contrast function, wherein the contrast scaling function maps $L_S/L$ values to scaler values ($f$), where L denotes an input luminance value and $L_S$ denotes the ambient-light signal; and generating the ambient-light adjustment function based on the contrast function, the contrast scaling function, and a mapping function mapping linear luminance values to quantized luminance values.

11. The method of EEE 10, wherein computing the contrast function comprises computing $$\text{contrast} = \frac{LB - LA}{LB + LA},$$

wherein LA and LB denote input linear luminance values, where LB>LA.

12. The method of EEE 11, wherein the contrast scaling function comprises computing the function $$f\left(\frac{L_S}{L}\right) = 1 \Big/ \left(0.93e^{\frac{-\ln\left(\frac{L_S}{L}\right)^3}{155}} + 0.07\right)$$

13. The method of EEE 12, wherein generating the ambient-light adjustment function further comprises:

receiving a starting luminance value L0 in linear luminance;

receiving an input N, where N denotes a constant representing a number of quantization steps in non-linear luminance;

setting a variable A=L0;

for iteration i, wherein i=1 to N:

computing B=PQ2L(L2PQ(A)+1/N), wherein L2PQ( ) denotes a function mapping linear luminance values to quantized luminance values, and PQ2L( ) denotes a function mapping quantized luminance values to linear luminance values;

computing M=(B−A)/(B+A);

computing F=$f(L_S/A)$;

computing AS=A(1+M*F)/(1−M*F);

computing L(i)=PQ2L(L2PQ(L0)+i/N);

outputting (L(i), AS), wherein given luminance L(i), AS represents the corresponding mapping according to the ambient-light adjustment function; and setting A=AS for the next iteration.

14. The method of EEE 13, wherein the mapping function mapping linear luminance values to quantized luminance values is determined according to the SMPTE ST 2084 (PQ) recommendation.

15. The method of EEE 10, wherein determining the contrast scaling function further comprises: given an input image and a value of a surrounding ambient light, determining a scaled contrast value so that an observer adapted to the surrounding ambient light perceives the input image at its original contrast.

16. An apparatus comprising a processor and configured to perform any one of the methods recited in EEEs 1-15.

17. A non-transitory computer-readable storage medium having stored thereon computer-executable instruction for executing a method in accordance with any one of the EEEs 1-15.

The invention claimed is:

1. A method for ambient-light-adaptive display management with a processor, the method comprising:

receiving an input image, metadata related to the input image, and an ambient-light signal, wherein the metadata comprises at least one of a minimum luminance value, a midpoint luminance value and a maximum luminance value of the input image;

generating an ambient-light adjustment function which maps input luminance values in a reference viewing environment to output luminance values in a target viewing environment, wherein the target viewing environment is determined based on the ambient-light signal;

applying the ambient-light adjustment function to the input image to generate a virtual image, and to said at least one of the minimum, midpoint and maximum luminance values to generate new metadata for the virtual image;

obtaining a tone-mapping function based on the new metadata and parameters for a target display; and applying the tone-mapping function to the virtual image to generate an output image for the target display, wherein generating the ambient-light adjustment function comprises:

accessing a contrast function to generate contrast values between two input luminance values when there is no need for ambient-light adjustment;

determining a contrast scaling function to scale the output of the contrast function, wherein the contrast scaling function maps $L_S/L$ values to scaler values (ƒ), where L denotes an input luminance value and $L_S$ denotes the ambient-light signal; and generating the ambient-light adjustment function based on the contrast function, the contrast scaling function, and a mapping function mapping linear luminance values to quantized luminance values.

2. The method of claim 1, wherein the ambient-light adjustment function is an identity function when ambient light intensity in the target viewing environment is approximately the same as in the reference viewing environment.

3. The method of claim 1, wherein in the ambient-light adjustment function, for one or more input luminance values, the corresponding output values are higher than the input values when ambient light intensity in the target viewing environment is higher than ambient light intensity in the reference viewing environment.

4. The method of claim 1, wherein in the ambient-light adjustment function, for one or more input luminance values, the corresponding output values are lower than the input values when ambient light intensity in the target viewing environment is lower than ambient light intensity in the reference viewing environment.

5. The method of claim 1, wherein the parameters for the target display comprise a target display minimum brightness value and a target display maximum brightness value.

6. The method of claim 5, wherein computing the target display minimum brightness value and the target display maximum brightness value is based at least on the ambient light signal.

7. The method of claim 6, wherein computing the target display minimum brightness value and the target display maximum brightness value comprises:

receiving one or more global dimming control parameters;

receiving a user-adjusted brightness control input;

receiving one or more parameters characterizing the target display; and determining the target display minimum brightness value and the target display maximum brightness value based on the global dimming control parameters, the user-adjusted brightness control input, the ambient light signal, and the one or more parameters characterizing the target display.

8. The method of claim 7, further comprising, computing:

target_backlight=anchor_pq*anchor_pq_weight+anchor_power*anchor_power_weight;

adjusted_backlight=target_backlight*user_brightness*amb_gain*(ambient_lux*ambient_reflections−ambient_offset);

clamped_backlight=max(backlight_min*half_contrast, min(backlight_max/half_contrast, adjusted_backlight));

target_display_max=clamped_backlight*half_contrast;

target_display_min=clamped_backlight/half_contrast;

wherein anchor_pq and anchor_power are global dimming parameters, anchor_pq_weight, anchor_power_weight, amb_gain, ambient_reflections, ambient_offset, denote weighting coefficients, half_contrast, backlight_min and backlight_max are parameters characterizing the target display, and target_display_min and target_display_max denote respectively the target display minimum brightness value and the target display maximum brightness value.

9. The method of claim 1, wherein computing the contrast function comprises computing $$\text{contrast} = \frac{LB - LA}{LB + LA},$$

wherein LA and LB denote input linear luminance values, where LB>LA.

10. The method of claim 9, wherein the contrast scaling function comprises computing the function $$f\left(\frac{L_S}{L}\right) = 1 \Big/ \left(0.93e^{-\frac{\ln\left(\frac{L_S}{L}\right)^3}{155}} + 0.07\right).$$

11. The method of claim 10, wherein generating the ambient-light adjustment function further comprises:

receiving a starting luminance value L0 in linear luminance;

receiving an input N, where N denotes a constant representing a number of quantization steps in non-linear luminance;

setting a variable A=L0;

for iteration i, wherein i=1 to N:

computing B=PQ2L(L2PQ(A)+1/N), wherein L2PQ( ) denotes a function mapping linear luminance values to quantized luminance values, and PQ2L( ) denotes a function mapping quantized luminance values to linear luminance values;

computing M=(B−A)/(B+A);

computing F=ƒ($L_S$/A);

computing AS=A (1+M*F)/(1−M*F);

computing L(i)=PQ2L(L2PQ(L0)+i/N);

outputting (L(i), AS), wherein given luminance L(i), AS represents the corresponding mapping according to the ambient-light adjustment function; and setting A=AS for the next iteration.

12. The method of claim 11, wherein the mapping function mapping linear luminance values to quantized luminance values is determined according to the SMPTE ST 2084 (PQ) recommendation.

13. The method of claim 1, wherein determining the contrast scaling function further comprises: given an input image and a value of a surrounding ambient light, determining a scaled contrast value so that an observer adapted to the surrounding ambient light perceives the input image at its original contrast.

14. The method of claim 1, wherein the midpoint luminance value is an average luminance value, a median luminance value or a mode luminance value.

15. An apparatus comprising a processor and configured to perform the method recited in claim 1.

16. A tangible computer program product having instructions which, when executed by a computing device or system, cause said computing device or system to perform with one or more processors the method of claim 1.

17. A method for ambient-light-adaptive display management with a processor, the method comprising:

receiving an input image, metadata related to the input image, and an ambient-light signal, wherein the metadata comprises at least one of a minimum luminance value, a midpoint luminance value and a maximum luminance value of the input image;

generating an ambient-light adjustment function which maps input luminance values in a reference viewing environment to output luminance values in a target viewing environment, wherein the target viewing environment is determined based on the ambient-light signal;

applying the ambient-light adjustment function to said at least one of the minimum, midpoint and maximum luminance value, to generate new metadata;

obtaining a first tone-mapping function based on the new metadata and parameters for a target display;

obtaining a second tone-mapping function based on the ambient-light adjustment function and the first tone-mapping function; and applying the second tone-mapping function to the input image to generate an output image for the target display, wherein generating the ambient-light adjustment function comprises:

accessing a contrast function to generate contrast values between two input luminance values when there is no need for ambient-light adjustment;

determining a contrast scaling function to scale the output of the contrast function, wherein the contrast scaling function maps $L_S/L$ values to scaler values ($f$), where L denotes an input luminance value and $L_S$ denotes the ambient-light signal; and generating the ambient-light adjustment function based on the contrast function, the contrast scaling function, and a mapping function mapping linear luminance values to quantized luminance values.

18. An apparatus comprising:

a display manager for mapping an image having a first dynamic range to a second dynamic range of a target display, the display manager being configured to:

receive a first image and metadata related to the first image, the metadata comprising at least one of a minimum luminance value, a midpoint luminance value and a maximum luminance value of the first image;

obtain a tone-mapping function based on the metadata related to the first image and parameters for the target display; and apply the tone-mapping function to the first image to generate an output image for the target display, the apparatus further comprising:

an ambient light sensor providing an ambient-light signal; and a processor configured to:

receive an input image and metadata related to the input image comprising at least one of a minimum luminance value, a midpoint luminance value and a maximum luminance value of the input image;

generate an ambient-light adjustment function which maps input luminance values in a reference viewing environment to output luminance values in a target viewing environment, wherein the target viewing environment is determined based on the ambient-light signal of the ambient light sensor;

apply the ambient-light adjustment function to the input image to generate a virtual image, and to said at least one of the minimum, midpoint and maximum luminance value of the metadata of the input image to generate new metadata for the virtual image; and output the virtual image and the new metadata to the display manager, wherein generating the ambient-light adjustment function comprises:

accessing a contrast function to generate contrast values between two input luminance values when there is no need for ambient-light adjustment;

determining a contrast scaling function to scale the output of the contrast function, wherein the contrast scaling function maps $L_S/L$ values to scaler values ($f$), where L denotes an input luminance value and $L_S$ denotes the ambient-light signal; and generating the ambient-light adjustment function based on the contrast function, the contrast scaling function, and a mapping function mapping linear luminance values to quantized luminance values.

* * * * *